United States Patent [19]

Nelson et al.

[11] 3,953,382

[45] Apr. 27, 1976

[54] DETERGENT COMPOSITIONS

[75] Inventors: Roger E. Nelson, Verona; Allan H. Gilbert, Oradell, both of N.J.

[73] Assignee: Lever Brothers Company, New York, N.Y.

[22] Filed: May 30, 1973

[21] Appl. No.: 365,342

[52] U.S. Cl. ..... 252/548; 252/528; 252/529; 252/530; 252/547; 252/549; 252/DIG. 1; 252/DIG. 4; 252/DIG. 15

[51] Int. Cl.[2] ..... C11D 1/825

[58] Field of Search ..... 252/528, 529, 530, 547, 252/548, 549, DIG. 4

[56] References Cited

UNITED STATES PATENTS

| | | | |
|---|---|---|---|
| 2,576,913 | 12/1951 | Baird et al. | 252/548 |
| 2,577,503 | 12/1951 | Baird et al. | 252/548 |
| 2,787,595 | 4/1957 | Webb | 252/549 X |
| 2,831,815 | 4/1958 | Klisch | 252/548 |
| 3,250,719 | 5/1966 | Schmolka et al. | 252/548 |
| 3,281,368 | 10/1966 | Zimmerer et al. | 252/529 X |
| 3,308,067 | 3/1967 | Diehl | 252/547 X |
| 3,317,430 | 5/1967 | Priestley et al. | 252/547 |
| 3,336,233 | 8/1967 | Lyness et al. | 252/549 |
| 3,354,091 | 11/1967 | Hearn et al. | 252/548 X |

FOREIGN PATENTS OR APPLICATIONS

| | | |
|---|---|---|
| 716,641 | 10/1954 | United Kingdom |
| 592,968 | 2/1960 | Canada |

*Primary Examiner*—Herbert B. Guynn
*Attorney, Agent, or Firm*—Kenneth F. Dusyn; James J. Farrell; Arnold Grant

[57] ABSTRACT

Compositions having detergent properties and improved anti-redeposition properties are prepared based on a ternary combination of a water-soluble polyetheneoxy organic nonionic detergent compound, a substantially water-insoluble polyalkyleneoxy nonionic compound, and an organic compound selected from the group consisting of N-alkanol alkaneamides, tertiary amine oxides having one long alkyl chain, and dialkyl sulfoxides having one long chain.

9 Claims, No Drawings

DETERGENT COMPOSITIONS

BACKGROUND OF THE INVENTION

1. Field of the Invention

Detergency as applied to the washing of fabrics, involves both the removal of undesired matter from the fabric and the prevention of redeposition on the fabric. It is known that dirt which is removed from fabrics during a washing operation is suspended in the wash water and tends to redeposit on the fabric. Under appropriate conditions, dirt removed from one fabric in a mixed load can deposit on a clean portion of a second fabric to make the second fabric appear less clean than before washing.

In the past, the preponderance of washable fabrics in common use consisted of cotton of various types. Redeposition of soil on cotton has long been recognized as a problem, which, however, was related primarily to particulate soil. It has been known for some time that this problem with respect to cotton fabrics can be ameliorated by the use of sodium carboxymethyl cellulose.

With the growing popularity of polyester fabrics, alone and in the form of blends, a laundering problem due to difficulties with both removal and redeposition of oily soil has developed. Since sodium carboxymethylcellulose does not affect oily soil redeposition, there is a need to alleviate this problem with polyester fabrics by some other means.

The polyester fabrics and most other synthetic fabrics are more hydrophobic than is cotton. Consequently, there is a greater tendency for oily soils to deposit on the great majority of synthetic fabrics than on cotton. The redeposition characteristics of spun Dacron are considered to be representative of those of the polyester fabrics.

The most pertinent prior art known to applicants is set forth below.

Canadian Pat. No. 698,560

Relates to a blend of ethylene oxide adducts of alkyl phenols, one portion comprising adducts of polyalkylated phenols having an oxyethylene content of about 60–80%, and the other portion comprising adducts of monoalkylated phenols having an oxyethylene content of about 25–55%.

Canadian Pat. No. 592,968

Discloses foaming detergent compositions comprising a mixture of an anionic and a nonionic short chain ethylene oxide adduct of an aliphatic alcohol of from 8–18 carbon atoms.

British Pat. No. 716,641

British Patent No. 716,641 discloses a cleaning composition comprising a mixture of two or more nonionic surface-active agents, of which at least one is a short chain ethylene oxide adduct having 1–5 EO groups. The composition is said to have improved detergency due to the short chain ethylene oxide adduct, which may be derived from a $C_{12}$ fatty alcohol.

Canadian Pat. No. 1,241,574

Discloses detergent compositions comprising a water-soluble anionic or nonionic organic detergent compound and a detergency improver therefor which is an ethylene oxide adduct of a $C_8$–$C_{15}$ substantially unbranched monohydric alkanol having 10–15% EO.

German Pat. application No. 1,141,743

Discloses detergent compositions comprising 15–80%, preferably 30–50% of any alkyl polyglycolether sulfate and 85–20%, preferably 70–50% of an alkyl polyglycol ether having 1–10, and particularly, 3–6 mol EO. The specific combination is said to have excellent detergency properties, which are much better than the sum of their single effects.

U.S. Pat. Nos. 2,576,913 and 2,577,503

Disclose a nonionic detergent with a beta-monohydroxyethyl amide of a fatty acid as a detergency improver.

U.S. Pat. No. 2,831,815

Relates to mixtures of nonionic detergents and dialkanolamides of fatty acids having 10–16 carbon atoms.

U.S. Pat. No. 2,934,568

Discloses condensates of branched-chain alcohols and ethylene oxide used in conjunction with a builder and sodium carboxymethylcellulose.

U.S. Pat. No. 3,696,056

Relates to a ternary mixture for regulating the foam profile of a detergent system consisting essentially of a saturated fatty acid or soap having about 8 to 30 carbon atoms, a nonionic $C_{12}$ to $C_{20}$ polyethoxylated linear alcohol, and as the third component an amine or amide having about 14 to 22 carbon atoms.

SUMMARY OF THE INVENTION

It has now been found that a detergent composition having excellent anti-redeposition activity on spun Dacron can be prepared by blending together a ternary combination of a water-soluble polyetheneoxy organic nonionic detergent compound, a substantially water-insoluble polyalkyleneoxy nonionic compound and an organic compound selected from the group consisting of N-alkanol alkaneamides, tertiary amine oxides having one long alkyl chain, and dialkyl sulfoxides having one long chain.

It is an object of the present invention to provide a detergent composition having excellent anti-redeposition properties.

It is another object of the invention to provide a detergent composition effective in an aqueous medium to clean spun Dacron and to inhibit the redeposition of soil thereon.

Accordingly, a broad aspect of the present invention lies in a detergent composition having as an essential characteristic the property of substantially preventing redeposition of soil removed from spun Dacron washed in aqueous solutions of the detergent.

In another aspect, the invention provides a ternary combination of chemical compounds, said ternary combination being suitable for inclusion in a detergent composition to enhance the anti-redeposition properties thereof on spun Dacron.

In a more narrow aspect of the invention there is provided a ternary combination of detergents and detergent-compatible compounds capable of cleaning spun Dacron without permitting a substantial amount of soil to redeposit on the fabric.

The detergent compositions of the invention contain three essential components comprising the ternary combination referred to hereinabove. The "component" may be, and usually is, itself a mixture of class of individual species within a range of molecular weights and ethylene oxide content. More than one species may be present together in one or more of the three classes and the ternary combination of classes may comprise, if desired, considerably more than three species.

Accordingly, it is a further aspect of the present invention to provide a detergent composition comprising a ternary combination of:

i. a water-soluble polyetheneoxy organic nonionic detergent compound, ii. a substantially water-insoluble polyetheneoxy nonionic compound and, iii. an organic compound selected from the group consisting of a. N-alkanol alkaneamides having the formula

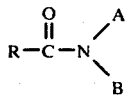

wherein RC=O is an acyl group having about 8 to about 18 carbon atoms, A is an alkanol group having 1 – 3 carbon atoms, and B is a member selected from the group of hydrogen and an alkanol group having 1 – 3 carbon atoms, b. tertiary amine oxides having the formula $R^1R^2R^3N \rightarrow O$ wherein $R^1$ is an alkyl group having about 8 to about 18 carbon atoms, and $R^2$ and $R^3$ are independently methyl, ethyl, or hydroxyethyl groups, and c. alkyl sulfoxides having the formula $R^4R^5S \rightarrow O$ wherein $R^4$ is a radical selected from the group consisting of 1. alkyl having about 8 to about 18 carbon atoms, 2. a radical having the formula

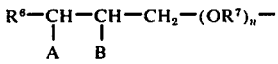

wherein $R^6$ is an alkyl radical having about 7 to about 15 carbon atoms, A and B are hydroxyl or hydrogen, one of A and B being hydrogen, $R^7$ is a divalent alkylene radical having 2 – 4 carbon atoms, and n is an integer from 0 to 2, and 3. $R^5$ is an alkyl radical having 1 or 2 carbon atoms, or a hydroxyethyl radical, mixtures of a, b, and c may be employed, the proportions of (i), (ii), and (iii) being selected to provide improved anti-redeposition characteristics when said composition is employed to wash spun Dacron.

A first essential component is a water-soluble polyethenoxy organic nonionic detergent compound.

The water-soluble polyetheneoxy organic detergent compounds suitable for use in the practice of the invention may be characterized broadly as ethylene oxide condensates of organic hydrophobic compounds bearing a labile hydrogen atom in a polar substituent, said organic hydrophobic compounds being within a molecular weight range such that when serving as a base for a resulting ethylene oxide condensate, said condensate is capable of having detergent properties at a sufficiently high ethylene oxide content.

Suitable hydrophobic bases falling within the foregoing description are aliphatic alcohols and mixtures thereof having from about 10 to about 15 carbon atoms, corresponding to an average molecular weight of about 158 to about 228. The alcohol is preferably straight-chain but may contain 0% to about 25% lower alkyl branching, mainly methyl, with some 2 – 3 carbon alkyl groups, on the 2-position carbon of the alcohol molecule.

Other suitable hydrophobic compounds include a. the polyoxypropylene diols which form the hydrophobic base of the Pluronics. "Pluronic" is a trade mark of the Wyandotte Chemical Corp. The aforementioned hydrophobic base is a water-insoluble and has a molecular weight from about 1500 to about 1800.

b. The reaction product of ethylene diamine and propylene oxide to provide a molecular weight of about 2500 to about 3000.

c. Alkylphenols having an alkyl group of about 6 to about 12 carbon atoms. The alkyl group may be straight or branched and may be derived from a propylene polymer, diisobutylene, hexene, nonene, or dodecene, for example, or mixtures of these.

The ethylene dioxide content of the detergent molecule may range from 52% to about 80% by weight, preferably from about 60% to about 70% by weight.

Among the water-soluble polyetheneoxy organic nonionic detergent compounds useful in the ternary combinations of the instant invention are 1. condensates of ethylene oxide and a primary or secondary alkanol having about 8 to about 16 carbon atoms, the proportion of combined ethylene oxide being from about 52% to about 80% by weight, and mixtures thereof.

2. condensates of ethylene oxide and an alkanol having 14–15 carbon atoms with about 25% 2-methyl branching, the proportion of combined ethylene oxide in said condensate being from about 52% to about 80% by weight, and mixtures thereof.

3. condensates of ethylene oxide and a hydrophobic base selected from the group consisting of a. the reaction product of propylene oxide and propylene glycol, said reaction product having a molecular weight of about 1800, and b. the reaction product of propylene oxide and ethylene diamine, said reaction product having a molecular weight of about 2500 to about 3000.

The water-soluble polyetheneoxy organic nonionic detergent compounds may include:

1. Poly (ethylene oxide) condensates of primary or secondary aliphatic alcohols having about 11 to about 15 carbon atoms, said condensates having an average of about 9 molar proportions of ethylene oxide per mole of alcohol, and mixtures thereof.

2. Poly (ethylene oxide) condensates of primary aliphatic alcohols having about 12 to about 15 carbon atoms and having about 25% lower alkyl branching on the 2-carbon, said condensates having an average of about 9 to about 20 molar proportions of ethylene oxide per mole of alcohol, and mixtures thereof.

3. A condensate of 1 mole of octylphenol and about 7–8 molar proportions of ethylene oxide.

4. Poly (ethylene oxide) condensates of linear primary alcohols having about 14–15 carbon atoms, and averaging about 13.5 carbon atoms, and having about 25% lower alkyl branching on the 2-carbons, said condensates having an average of about 13.5 molar proportions of ethylene oxide per mole of alcohol.

5. The poly (ethylene oxide) condensates of alkylphenols, e.g., the condensation of products of alkylphenols having an alkyl group containing from about 6 to 12 carbon atoms in either a straight chain or branched chain configuration, with ethylene oxide, said ethylene oxide being present in amounts equal to 6 to 25 moles of ethylene oxide per mole of alkylphenol. The alkyl substituent in such compounds may be derived from polymerized propylene, diisobutylene, octene, dodecene, or nonene, for example.
6. Those derived from the condensation of ethylene oxide with the product resulting from the reaction of propylene oxide and ethylenediamine. For example, compounds containing from about 40% to about 80% poly oxyethylene by weight and having a molecular weight of from about 5,000 to about 11,000 resulting from the reaction of ethylene oxide groups with a hydrophobic base constituted of the reaction product of ethylene diamine and excess propylene oxide, said hydrophobic base having a molecular weight of the order of 2,500 to 3,000, are satisfactory.
7. Compounds formed by the simultaneous polymerization of propylene oxide and ethylene oxide, and containing randomly positioned propeneoxy and etheneoxy groups.

As examples of specific nonionic detergent compounds finding utility in accordance with the invention, there may be mentioned:

A. branched-chain nonyl phenol condensed with about 8–14 molar proportions of ethylene oxide,
B. a mixed $C_{11}$–$C_{15}$ secondary alcohol condensed with 9–14 molar proportions of ethylene oxide, the mixed secondary alcohols having the following approximate chain-length distribution:

| | |
|---|---|
| 2% | $C_{10}$ |
| 15% | $C_{11}$ |
| 21% | $C_{12}$ |
| 23% | $C_{13}$ |
| 17% | $C_{14}$ |
| 15% | $C_{15}$ |
| 7% | $C_{16}$, |

C. a mixed $C_{14}$–$C_{15}$ alcohol made by the Oxo process condensed with about 9–15 molar proportions of ethylene oxide, and
D. a mixture of about 65% $C_{14}$ and about 35% $C_{15}$ synthetic straight-chain primary alcohols condensed with about 9–15 molar proportions of ethylene oxide.

The nonionic detergents as defined for purposes of this invention have, except for the Pluronics as hereinbefore described over 51% by weight of ethylene oxide.

A second essential component is a substantially water-insoluble polyalkyleneoxy nonionic organic compound.

The substantially water-insoluble nonionic compounds comprising one component of the ternary mixtures of the present invention may be characterized as compounds analogous in molecular structure to the water-soluble detergent compounds described hereinabove, i.e., having hydrophobic bases within the same group as suitable for the detergent compounds but having a lower ethylene oxide content, desirably about 10% to about 51% by weight.

Suitable substantially water-insoluble nonionic compounds are:

a. condensates of ethylene oxide and monohydric primary or secondary alkanols having about 8 to about 16 carbon atoms, the proportion of ethylene oxide being about 10% to about 51%, preferably from about 37% to about 51%. by weight.

The alkanols are substantially unbranched, and may normally have from 0% to about 35% by weight of lower alkyl branching, e.g., methyl, ethyl, propyl, or isopropyl groups, or mixtures thereof, usually on the 2-carbon of the alkanol.

b. polymers of propylene oxide having a molecular weight of about 1500 to 1800. These compounds have substantially no ethylene oxide, and are referred to as the polyoxypropylene hydrophobic base to which ethylene oxide is added in the manufacture of Pluronics, a trademark of Wyandotte Chemicals Corporation,
c. the reaction product of propylene oxide and ethylenediamine, the molecular weight of the reaction product being about 2500 to about 3000,
d. ethylene oxide condensates of the hydrophobic bases described in (b) and (c), said condensates having from about 10% ethylene oxide in the molecule by weight,
e. compounds which are polyethylene oxide condensates of alkyl phenols, e.g., the condensation products of alkylphenols having an alkyl group containing from about 6 to 12 carbon atoms in either a straight chain or branched chain configuration, with ethylene oxide, said ethylene oxide being present in amounts equal to 3 to 5 moles of ethylene oxide per mole of alkylphenol,
f. condensates of ethylene oxide and an alkanol having 14–15 carbon atoms with about 25% 2-methyl branching, the proportion of combined ethylene oxide in said condensate being from about 10% to about 51% by weight, and mixture thereof.

Representative specific ethylene oxide condensates useful as the substantially water-insoluble nonionic component are the ethylene oxide condensates of a polyoxypropylene hydrophobic base having a molecular weight from about 1500 to about 1800, said condensates having an ethylene oxide content of about 10% by weight, and the ethylene oxide condensates of the primary or secondary substantially unbranched octanols, nonanols, decanols, undecanols, dodecanols, tridecanols, tetradecanols and pentadecanols having an average ethylene oxide content ranging from about 10% to about 51% by weight. Further examples thereof include the commercially available ethylene oxide condensate of $C_{14}$–$C_{15}$ "oxo" alcohol with about 25% 2-methyl branching and having an average ethylene oxide content of 37% by weight, the ethylene oxide condensate of $C_{14}$–$C_{15}$ "oxo" alcohol with about 25% 2-(lower akyl) branching and having an average ethylene oxide content of 50% by weight, the ethylene oxide condensate of $C_{11}$–$C_{13}$ secondary straight chain alcohol having an average ethylene oxide content of 51% by weight, and the ethylene oxide condensate of $C_8$–$C_{10}$ (1/1) primary straight chain alcohol having an average ethylene oxide content of 48% by weight.

Particularly preferred are compositions wherein the substantially water-insoluble nonionic component is a member selected from the group consisting of the ethylene oxide condensate of $C_{12}$–$C_{15}$ oxo alcohol with about 25% 2-(lower alkyl) branching and an average ethylene oxide content of about 37% by weight, a polyoxyethylene derivative of a reaction product of propylene glycol and propylene oxide having a molecular weight of about 1500 to 1800, the ethylene oxide condensate having about 10% ethylene oxide adduct by weight, and the ethylene oxide condensate of a $C_{11}$ to $C_{15}$ secondary alcohol having a substantially straight chain configuration, the ethylene oxide condensate having an average of about 40% ethylene oxide by weight.

The third essential component of the ternary mixture is a member selected from the group of organic compounds consisting of N-alkanol alkaneamides, tertiary amine oxides having one long alkyl chain, and dialkyl sulfoxides having one long alkyl chain.

The N-alkanol alkaneamides suitable for use in the present invention are commonly referred to as "alkanolamides" and are the N-substituted mono - and dilower alkanolamides of fatty acids having from 12—18 carbon atoms. Suitable N-substituted alkanolamides include lauric diethanolamide, oleic diethanolamide, myristic diethanolamide, tallow diethanolamide, cocomonoethanolamide, lauric monoethanolamide and lauric isopropanolamide.

By the term "tertiary amine oxides having one long alkyl chain" is meant compounds having the following general formula, $R_1R_2R_3N \rightarrow O$, wherein $R_1$ is an alkyl radical of from about 8 to 18 carbon atoms and $R_2$ and $R_3$ are each methyl, ethyl or hydroxyethyl radicals. Suitable amine oxides include dimethyloctyl amine oxide, dimethyldecylamine oxide, dimethyldodecylamine oxide, dimethyltetradecylamine oxide, dimethylhexadecylamine oxide and N,N-bis (hydroxyethyl) dodecylamine oxide.

The term "dialkyl sulfoxides having one long chain" refers to compounds having the following general formula, $RR^1S \rightarrow O$, wherein R is an alkyl, alkenyl, beta - or gamma - monohydroxyalkyl radical or an alkyl or beta - or gamma-monohydroxyalkyl radical containing one or two other oxygen atoms in the chain, the R groups ranging from 10 to 18 carbon atoms in chain length, and wherein $R^1$ is methyl, ethyl or alkylol. Suitable sulfoxide compounds include the following:

dodecyl methyl sulfoxide
3-hydroxy tridecyl methyl sulfoxide
2-hydroxy dodecyl methyl sulfoxide
3-hydroxy-4-decyloxybutyl methyl sulfoxide
3-hydroxy-4-dodecyloxybutyl methyl sulfoxide
2-hydroxy-3-decyloxypropyl methyl sulfoxide
2-hydroxy-3-dodecyloxypropyl methyl sulfoxide
dodecyl ethyl sulfoxide
2-hydroxydodecyl ethyl sulfoxide
dodecyl-2-hydroxyethyl sulfoxide
dodecyl acetonyl sulfoxide
tetradecyl-2-hydroxyethoxyethyl sulfoxide
dodecyl-2-hydroxyethoxyethyl sulfoxide Specifically the preferred compounds for use as the third component of the ternary combination are:

a. the N-(2-ethanol) derivative of dodecaneamide,
b. the N-(2-ethanol) derivative of tetradecaneamide,
c. the N-(2-ethanol) derivative of a mixed alkaneamide having the molecular weight distribution substantially corresponding to that of the combined fatty acids of coconut oil, and
d. the N-isopropanol derivative of an alkaneamide selected from the group consisting of dodecaneamide and tetradecane amide, and mixtures thereof.
e. dimethyl dodecyl amine oxide
f. N,N-bis(2-hydroxyethyl)dodecyl amine oxide
g. dodecyl methyl sulfoxide
h. tetradecyl methyl sulfoxide
i. hexadecyl methyl sulfoxide and mixtures thereof.

While the inclusion of relatively small amounts of any one of the three essential components in the ternary combination provides a desirable composition, it has been found that best anti-redeposition characteristics are obtained when the proportion of the water-soluble polyetheneoxy organic nonionic detergent compound is about 15% to about 70% by weight of the ternary mixture, the proportion of the substantially water-insoluble polyetheneoxy nonionic compound is about 2% to about 80% by weight, and the proportion of the organic compound is about 2% to 80% by weight and the weight ratio of water-insoluble polyetheneoxy nonionic compound to organic compound is about 15:1 to about 1:15, the percentages being by weight of the ternary combination.

Good performance is given by ternary mixtures containing 30–65% of the nonionic detergent compound and 70–35% of a mixture comprising the substantially water-insoluble nonionic compound and an organic compound selected from the group consisting of alkanolamides, long-chain tertiary amine oxides and dialkyl sulfoxides in a ratio from 4:1 to 1:4 by weight of the ternary mixture. Especially good performance is given by ternary mixtures containing 40–60% of the nonionic detergent compound, and 60–40% of a mixture comprising the substantially water-insoluble nonionic compound and an organic compound selected from the group consisting of alkanolamides, long-chain tertiary amine, oxides and dialkyl sulfoxides in a ratio from 2:1 to 1:2 the percentages being by weight of the ternary mixture.

The ternary combination of the present invention may be formulated with a detergent builder as a detergency aid, for example those mentioned hereinafter, to provide a commercially valuable detergent composition. However, the desirable anti-redeposition properties of the ternary mixture do not depend upon the presence of a builder. The proportion of builder may be from 0% to about 90%, whole composition basis.

The term "builder" as used herein refers to any substance compatible with, and assisting the detergency of, the aforementioned ternary combination.

Suitable builder compounds are tetrasodium and tetrapotassium pyrophosphate, pentasodium and pentapotassium tripolyphosphate, sodium or potassium carbonate, sodium or potassium silicates having an $SiO_2 : Na_2O$ ratio of about 1:1 to about 3.2:1, hydrated or anhydrous borax, sodium or potassium sesquicarbonate, the sodium or potassium aminopolycarboxylates, such as nitrilotriacetates, N-(2-hydroxyethyl)-nitrilodiacetates, ethylene diamine tetraacetates, hydroxyethyl ethylene diamine triacetates, diethylene triamino pentaacetate, dihydroxyethyl glycine, phytates, polyphosphonates such as sodium or potassium ethane-1-hydroxy-1, 1-diphosphonate, etc.

Also useful are other organic detergent builders such as the sodium or potassium oxydisuccinates, sodium or potassium oxydiacetates, carboxymethyloxysuccinates, hydrofuran tetracarboxylates, ester-linked carboxylate derivatives of polysaccharides, such as the sodium and potassium starch maleates, cellulose phthalates, glycogen succinates, semi-cellulose diglycolates, starch, oxidized heteropolymeric polysaccharides, etc. The weight percent of the builder present in the built detergent composition is from an amount of about 6% and up to about 90% and preferably from about 20% to about 60%. Suitably, a builder may be present in the ratios of about 0.5 to about 10 parts by weight, preferably about 2 to about 5 parts by weight, for each part by weight of the ternary combination.

Other materials which may be present in the detergent compositions of the invention are those conventionally employed therein. Typical examples include the well-known soil suspending agents, corrosion inhibitors, dyes, perfumes, fillers, optical brighteners, enzymes, germicides, anti-tarnishing agents, and the like. The balance of the detergent composition may be water.

The detergent compositions of the present invention may be in any of the usual physical forms for such compositions, such as powders, beads, flakes, bars, tablets, liquids, pastes, and the like. The compositions may be prepared and utilized in the conventional manner.

Unbuilt ternary compositions in accordance with the present invention may contain in combination:

i. from about 1 to about 20 parts by weight of the water-soluble polyetheneoxy nonionic organic detergent component,
ii. from about 0.3 to about 10 parts by weight of the substantially water-insoluble nonionic compound, and
iii. from about 0.3 to about 10 parts by weight of the organic compound selected from the group consisting of N-alkanol alkaneamides, tertiary amine oxides having one long alkyl chain, and dialkyl sulfoxides having one long alkyl chain, and mixtures thereof.

The ternary composition described above is suitable for incorporation in a detergent composition to enhance the anti-redeposition properties thereof on spun Dacron. The parts by weight are expressed on the basis of the total of (i), (ii), and (iii).

Built detergent compositions in accordance with the present invention may contain:

a. from about 1% to about 20%, preferably about 5% to about 10%, of the water-soluble polyetheneoxy nonionic organic detergent component,
b. from about 0.3% to about 10%, preferably about 1% to about 6%, of the substantially water-insoluble polyalkyleneoxy nonionic compound,
c. from about 0.3% to about 10%, preferably about 1% to about 6%, of the organic compound selected from the group consisting of N-alkanol alkaneamides, tertiary amine oxides having one long alkyl chain, and dialkyl sulfoxides having one long alkyl chain,
d. from about 5% to about 90%, preferably about 20% to about 60%, of a detergency builder,
e. from about 5% to about 15% water, and
f. the balance, if any, to 100% consisting of small amounts, typically about 1% to about 15%, of miscellaneous conventional non-builder detergent adjuncts.

As a specific embodiment of the foregoing, there may be mentioned the following composition:

i. about 1% to about 10% of a condensate of a $C_{14}$–$C_{15}$ substantially linear primary alcohol and about 13.5 molar proportions of ethylene oxides, about 25% of the molecules of said alcohol having lower alkyl branching on the 2-carbon,
ii. about 0.2% to about 10% of a condensate of a $C_{12}$–$C_{15}$ substantially linear primary alcohol and about 3 molar proportions of ehtylene oxide, about 25% of the molecules of said alcohol having lower alkyl branching and the 2-carbon,
iii. about 0.2% to about 12% of N-ethanol alkeneamide derived from coconut oil, the weight ratio of (ii) to (iii) being 1:15 to 15:1,
iv. a detergent builder selected from the group consisting of sodium tripolyphosphate, sodium carbonate, and mixtures thereof, the weight ratio of said builder to the sum of (i) and (ii), and (iii) being from about 0.5 to about 10.

Optimum anti-redeposition results are obtained when the HLB of the mixed water-soluble and the substantially water-insoluble alkyleneoxy compounds is about 12 and the average percent ethoxylation is about 60%. However, excellent results are obtained within an HLB range of about 10 to about 12 (about 50% to about 60% ethoxylation), and for practical purposes the HLB may range from about 8 to 13 (about 40% to about 65% ethoxylation).

For a discussion of the significance of the characteristic referred to as HLB reference may be made to the bulletin "The Atlas HLB System" published by Atlas Chemical Industries, Wilmington, Delaware, (1962). Briefly, it will be understood that the term HLB refers to the "hydrophilelipophile balance", and for the etheneoxy compounds within the instant invention is numerically equal to one-fifth of the percentage by weight of the polyetheneoxyethanol portion of the molecule. The HLB of a mixture of similar etheneoxy compounds is calculated on the basis of an assumption of linear functionality.

Anti-redeposition activity data shown herein is determined by the following procedure:

Into a Terg-O-Tometer container fitted with an oscillating agitator to simulate automatic washing machine action are placed:

a. 1000 ml of water at 120°F and having a hardness of 180 ppm as $CaCo_3$ (2Ca : 1 Mg),
b. 3 swatches of spun Dacron and 3 swatches of Startex (cotton) measuring 3 × 3 inches,
c. detergent components equal to the indicated percentages of 0.18% of total detergent composition based on total weight of solution,
d. 2 grams of vacuum cleaner dust, all of which passes through an 80-mesh screen,
e. 1.5 grams of Spangler's modified artificial sebum having the composition set forth by W. G. Spangler, R. C. Roga, and H. D. Cross in J. Amer. Oil Soc., 44, (1967).

The artificial sebum composition simulates oily substances found on many garments prior to home washing.

The agitator is operated at the rate of 120 complete oscillations per minute, with the contents of the container at 120°F, for 20 minutes. The swatches are next given two 2-minute rinses in 1000 ml of 180 ppm water at 120°F, using the same equipment. The swatches are then dried in forced hot air for 60 minutes. The reflective value of the swatches is then determined by means of a Gardner Color Difference Meter, Model XL-10.

The values (R) shown herein are the average of six readings, one reading being taken on each side of each of the three swatches.

In the foregoing test procedure, the vacuum cleaner dust, being of a brown color, is employed primarily as an indicator for detecting and measuring the oily soil on the spun Dacron swatches. The degree of discoloration provided by the presence of the vacuum cleaner dust soil constitutes a measure of the amount of oily soil deposited.

The recorded figures are the direct readings of the instrument. The higher the reading, the less is the extent of deposition.

For a description of the Terg-O-Tometer, see Sanders and Lambert, J.A.O.C.S. 127, May 1950, pages 153–159.

For a better understanding of the invention reference may be made to the following Examples, which are illustrative, but not intended to be limitative, of the invention.

In the Examples set forth below, the mixtures containing sodium tripolyphosphate as the builder, namely the mixtures of Examples I through VI, XI, XII, and XIV, are prepared by making aqueous slurries of the components, the mixture after several minutes, becoming dry, friable, and free-flowing. In addition to the components listed in the several Examples, each mixture contains 5% sodium silicate solids at an $SiO_2$ : $Na_2O$ ratio of 2.4, 0.4% sodium carboxymethylcellulose, 10% water, 0.1% miscellaneous inert ingredients associated with the components, and sodium sulfate in an amount needed to for a 100% total. The percentages are expressed on the whole composition basis.

The mixtures containing no builder, and those containing sodium carbonate as the builder, are prepared by drum drying aqueous slurries of the indicated components. These are shown in Examples VII, IX, X and XIII. Additionally, each of these compositions contains 8% sodium silicate solids at an $SiO_2$ : $Na_2O$ ration of 2.4, 0.4% sodium carboxymethylcellulose, 7% water, 0.1% miscellaneous inert ingredients associated with the components, and sodium sulfate in an amount required for 100% total, basis drum-dried composition.

The anti-redeposition results are obtained by the procedure described hereinabove.

EXAMPLES I – IV

Examples I–IV illustrate the utility of the invention. In every instance where a single component or a binary mixture are tested, the corresponding ternary mixture is superior thereto with respect to anti-redeposition properties.

EXAMPLE I

Ternary Combination

A. A condensate of 13.5 moles (average) of ethylene oxide and 1 mole of a mixture of alkanols having 14–15 carbon atoms, the alkanols having about 25% lower alkyl branching on the 2-carbon.

B. A condensate of 3 moles (average) of ethylene oxide and 1 mole of a mixture of alkanols having 12 to 15 carbon atoms, the alkanols having about 25% lower alkyl branching on the 2-carbon, C. The monoethanolamide of fatty acids having the molecular distribution of the combined fatty acids in coconut oil.

Builder

Sodium tripolyphosphate in the proportion of 33%, whole composition basis.

| Reflectance Results (R) | | | |
|---|---|---|---|
| % Component | | | |
| A | B | C | R |
| 9 | — | — | 37.3 |
| — | 9 | — | 55.2 |
| — | — | 9 | 50.5 |
| 4.5 | 4.5 | — | 54.7 |
| 4.5 | — | 4.5 | 47.2 |
| — | 4.5 | 4.5 | 53.8 |

-continued

| Reflectance Results (R) | | | |
|---|---|---|---|
| % Component | | | |
| A | B | C | R |
| 2.25 | 4.5 | 2.25 | 64.5 |
| 2.25 | 2.25 | 4.5 | 65.0 |

The above reflectance values clearly show the superior anti-redeposition properties of the ternary combination.

EXAMPLE II

Ternary Combination

A. A condensate of about 9 moles (average) of ethylene oxide and 1 mole of a secondary alcohol having 11–15 carbon atoms, the hydroxyl group being randomly positioned along the chain.

B. Same as in Example I.

C. Same as in Example I.

Builder

Sodium tripolyphosphate in the proportion of 33%, whole composition basis.

| Reflectance Results (R) | | | |
|---|---|---|---|
| % Component | | | |
| A | B | C | R |
| 9 | — | — | 44.4 |
| — | 9 | — | 55.2 |
| — | — | 9 | 50.5 |
| | 4.5 | 4.5 | 53.8 |
| 4.5 | 2.25 | 2.25 | 63.7 |
| 2.25 | 4.5 | 2.25 | 65.3 |
| 2.25 | 2.25 | 4.5 | 65.2 |
| 3 | 3 | 3 | 64.7 |

EXAMPLE III

Ternary Combination

A. A condensate of 7 to 8 moles (average) of ethylene oxide and octyl phenol.

B. Same as in Example I.

C. Same as in Example I.

Builder

Sodium tripolyphosphate in the proportion of 33%, whole composition basis.

| % Component | | | |
|---|---|---|---|
| A | B | C | R |
| 9 | — | — | 60.3 |
| — | 9 | — | 55.2 |
| — | — | 9 | 50.5 |
| 4.5 | 4.5 | — | 60.1 |
| 4.5 | — | 4.5 | 55.1 |
| — | 4.5 | 4.5 | 53.8 |
| 4.5 | 2.25 | 2.25 | 62.2 |
| 3 | 3 | 3 | 64.8 |

EXAMPLE IV

Ternary Combination

A. Same as in Example I.

B. Tergitol 15-S-3, a condensate of ethylene oxide and a straight chain secondary alcohol having 11–15 carbon atoms. The condensate has an average of 3 molar proportions of ethylene oxide per mole of alcohol, corresponding to about 40% by weight of ethylene oxide.

C. Same as in Example I.

Builder

Sodium tripolyphosphate in the proportion of 33%, whole composition basis.

| Reflectance Results (R) % Component A | B | C | R |
|---|---|---|---|
| 9 | — | — | 37.3 |
| — | 9 | — | 39.2 |
| — | — | 9 | 50.5 |
| 4.5 | 4.5 | — | 43.6 |
| 4.5 | — | 4.5 | 47.2 |
| — | 4.5 | 4.5 | 45.8 |
| 4.5 | 2.25 | 2.25 | 65.4 |
| 2.25 | 2.25 | 4.5 | 64.9 |

EXAMPLE V

Ternary Combination

A. Same as in Example I.

B. Same as in Example I.

C. Lauric isopropanolamide

Builder

Sodium tripolyphosphate in the proportion of 33%, whole composition basis.

| Reflectance Results (R) % Component A | B | C | R |
|---|---|---|---|
| 9 | — | — | 37.3 |
| — | 9 | — | 55.2 |
| — | — | 9 | 51.9 |
| 4.5 | 4.5 | — | 54.7 |
| 4.5 | — | 4.5 | 50.6 |
| — | 4.5 | 4.5 | 55.5 |
| 2.25 | 4.5 | 2.25 | 61.4 |
| 2.25 | 2.25 | 4.5 | 63.1 |

EXAMPLE VI

Ternary Combination

A. Same as in Example I.

B. Same as in Example I.

C. Tetradecyl methyl sulfoxide.

Builder

Sodium tripolyphosphate in the proportion of 33%, whole composition basis.

| Reflectance Results (R) % Component A | B | C | R |
|---|---|---|---|
| 9 | — | — | 37.3 |
| — | 9 | — | 55.2 |
| — | — | 9 | 57.4 |
| 4.5 | 4.5 | — | 54.7 |
| — | 4.5 | 4.5 | 57.8 |
| 2.25 | 4.5 | 2.25 | 66.0 |
| 2.25 | 2.25 | 4.5 | 67.8 |
| 3 | 3 | 3 | 68.6 |

EXAMPLES VII – XII

The following examples demonstrate the improved anti-redeposition characteristics which can be obtained through the use of the ternary mixtures of the invention in the absence of a detergent builder and in the presence of two well-known builders, namely sodium tripolyphosphate and sodium carbonate, these representing respectively sequestrant and precipitant reagents for hard water salts.

The data indicate that no builder is required to obtain the benefits of the ternary combinations of the invention, and that the utility of the invention is not negated by the presence of a detergent builder.

In Examples VII–XII the three components of the ternary combination in each example are:

A. Same as in Example I.

B. A condensate of 3 moles (average) of ethylene oxide and 1 mole of a mixture of alkanols having about 12 to 15 carbon atoms, the alkanols having about 25% lower alkyl branching on the 2-carbon.

C. The monoethanolamide of fatty acids having the molecular distribution of the combined fatty acids in coconut oil.

EXAMPLE VII

9% total ternary combination.

No builder.

| Reflectance Results (R) % Component A | B | C | R |
|---|---|---|---|
| 9 | — | — | R |
| 9 | — | — | 38.6 |
| — | 9 | — | 39.4 |
| — | — | 9 | 36.2 |
| — | 4.5 | 4.5 | 36.9 |
| 4.5 | 2.25 | 2.25 | 66.6 |
| 2.25 | 4.5 | 2.25 | 59.1 |
| 2.25 | 2.25 | 4.5 | 59.9 |
| 3 | 3 | 3 | 66.9 |

EXAMPLE VIII

9% total ternary combination.

25% sodium tripolyphosphate builder.

| Reflectance Results (R) % Component A | B | C | R |
|---|---|---|---|
| 9 | — | — | 36.4 |
| — | 9 | — | 49.3 |
| — | — | 9 | 49.6 |
| 4.5 | 4.5 | — | 49.9 |
| 4.5 | — | 4.5 | 45.4 |
| 2.25 | 4.5 | 2.25 | 64.6 |
| 2.25 | 2.25 | 4.5 | 57.5 |
| 3 | 3 | 3 | 61.0 |

EXAMPLE IX

9% total ternary combination.

25% sodium carbonate builder.

| Reflectance Results (R) % Component A | B | C | R |
|---|---|---|---|
| 9 | — | — | 37.8 |
| — | — | 9 | 54.7 |
| 4.5 | 4.5 | — | 62.5 |
| 4.5 | — | 4.5 | 64.4 |
| — | 4.5 | 4.5 | 57.8 |
| 2.25 | 4.5 | 2.25 | 68.4 |
| 2.25 | 2.25 | 4.5 | 69.1 |
| 3 | 3 | 3 | 68.8 |

EXAMPLE X

9% total ternary combination.
55% sodium carbonate builder.

| Reflectance Results (R) % Component A | B | C | R |
|---|---|---|---|
| 9 | — | — | 46.0 |
| — | 9 | — | 58.8 |
| — | — | 9 | 52.9 |
| 4.5 | 4.5 | — | 51.5 |
| 4.5 | — | 4.5 | 50.2 |
| — | 4.5 | 4.5 | 59.2 |
| 2.25 | 4.5 | 2.25 | 62.9 |
| 2.25 | 2.25 | 4.5 | 62.5 |

EXAMPLE XI

12% total ternary combination.
33% sodium tripolyphosphate builder.

| Reflectance Results (R) % Component A | B | C | R |
|---|---|---|---|
| 12 | — | — | 40.2 |
| — | 12 | — | 58.0 |
| — | — | 12 | 52.9 |
| 6 | 6 | — | 52.2 |
| — | 6 | 6 | 52.6 |
| 3 | 6 | 3 | 64.9 |
| 3 | 3 | 6 | 65.1 |
| 4 | 4 | 4 | 65.4 |

EXAMPLE XII

15% total ternary combination.
33% sodium tripolyphosphate builder.

| Reflectance Results (R) % Component A | B | C | R |
|---|---|---|---|
| 15 | — | — | 38.4 |
| — | 15 | — | 51.3 |
| — | — | 15 | 51.8 |
| 7.5 | 7.5 | — | 45.6 |
| — | 7.5 | 7.5 | 53.7 |
| 3.75 | 7.5 | 3.75 | 68.8 |
| 3.75 | 3.75 | 7.5 | 64.8 |
| 5 | 5 | 5 | 65.5 |

EXAMPLE XIII

The following Example shows the utility of a ternary combination of the invention when the third essential component is lauric diethanolamide, and no builder is present.

Ternary Combination
A. Same as in Example I.
B. Same as in Example I.
C. Lauric diethanolamide.
Builder
None.

| Reflectance Results (R) % Component A | B | C | R |
|---|---|---|---|
| 9 | — | — | 38.6 |
| — | 9 | — | 39.4 |
| — | — | 9 | 51.6 |

-continued

| Reflectance Results (R) % Component A | B | C | R |
|---|---|---|---|
| 4.5 | — | 4.5 | 43.1 |
| — | 4.5 | 4.5 | 53.8 |
| 2.25 | 4.5 | 2.25 | 67.4 |
| 2.25 | 2.25 | 4.5 | 64.1 |
| 3 | 3 | 3 | 63.0 |

EXAMPLE XIV

This Example shows the utility of a ternary combination of the invention when the third essential component is stearyl dimethylamine oxide. The builder used in this instance is sodium tripolyphosphate, in the proportion of 33%, whole composition basis.

Ternary Combination
A. Same as in Example I.
B. Same as in Example I.
C. Stearyl dimethyl amine oxide.
Builder
33% sodium tripolyphosphate.

| Reflectance Results (R) % Component A | B | C | R |
|---|---|---|---|
| 9 | — | — | 37.3 |
| — | 9 | — | 55.2 |
| — | — | 9 | 68.8 |
| 4.5 | 4.5 | — | 54.7 |
| — | 4.5 | 4.5 | 63.5 |
| 4.5 | 2.25 | 2.25 | 70.6 |
| 2.25 | 2.25 | 4.5 | 69.8 |
| 3 | 3 | 3 | 71.1 |

Having thus described the invention, and having set forth the best modes to teach those skilled in the art an appreciation of the modifications within the purview thereof, the invention is limited only within the scope of the following claims.

What is claimed is:

1. A detergent composition comprising a ternary combination of:

i. a water-soluble polyetheneoxy organic nonionic detergent compound of a condensate of ethylene oxide and a primary or secondary alkanol having about 8 to about 16 carbon atoms, the proportion of combined ethylene oxide being from about 52% to about 80% by weight, and mixtures thereof;

ii. a substantially water-insoluble polyalkyleneoxy nonionic compound of a condensate of ethylene oxide and a primary or secondary alkanol having about 8 to about 16 carbon atoms, the proportion of combined ethylene oxide being from about 10% to about 51% by weight, and mixtures thereof; and iii. an organic compound selected from the group consisting of a. N-alkanol alkaneamides having the formula

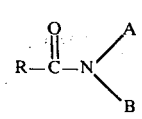

wherein R is an alkyl group having about 8 to about 18 carbon atoms, A is an alkanol group having 1–3 carbon atoms, and B is a member selected from the group of hydrogen and an alkanol group having 1–3 carbon atoms, b. tertiary amine oxides having the formula $R^1R^2R^3N \rightarrow O$ wherein $R^1$ is an alkyl group having about 8 to about 18 carbon atoms, and $R^2$ and $R^3$ are independently methyl, ethyl, or hydroxyethyl groups, and c. alkyl sulfoxides having the formula $R^4R^5S \rightarrow O$ wherein 1. $R^4$ is alkyl having about 10 to about 18 carbon atoms,
2. $R^5$ is an alkyl radical having 1 to 2 carbon atoms, or a hydroxyethyl radical, and mixtures thereof;

wherein the proportion of said water-soluble polyetheneoxy organic nonionic detergent compound (i) is about 15% to about 70% by weight of said ternary combination, the proportion of said substantially water-insoluble polyetheneoxy nonionic compound (ii) is about 2% to about 8% by weight, and the proportion of said organic compound (iii) is about 2% to 80% by weight and the weight ratio of (ii) to (iii) is about 15:1 to about 1:15, said percentages being by weight of said ternary combination.

2. A detergent composition in accordance with claim 1 wherein said water-soluble polyetheneoxy organic nonionic detergent compound is a condensate of ethylene oxide and an alkanol having 14–15 carbon atoms with about 25% 2-lower alkyl branching, the proportion of combined ethylene oxide in said condensate being from about 52% to about 80% by weight, and mixtures thereof.

3. A detergent composition in accordance with claim 1 wherein said substantially water-insoluble polyalkyleneoxy nonionic compound is a condensate of ethylene oxide and an alkanol having 14–15 carbon atoms with about 25% 2-lower alkyl branching, the proportion of combined ethylene oxide in said condensate being from about 10% to about 51% by weight, and mixtures thereof.

4. A detergent composition in accordance with claim 1 wherein said organic compound (iii) is a long-chain substituted amide selected from the group consisting of a. the N-(2-ethanol) derivative of dodecaneamide, b. the N-(2-ethanol) derivative of tetradecaneamide, c. the N-(2-ethanol) derivative of a mixed alkaneamide having the molecular weight distribution substantially corresponding to that of the combined fatty acids of coconut oil, and d. the N-isopropanol derivatives of an alkaneamide selected from the group consisting of dodecaneamide and tetradecaneamide, and mixtures thereof.

5. A detergent composition in accordance with claim 1 wherein said organic compound (iii) is a long-chain alkyl methyl sulfoxide wherein said long chain alkyl group is a member selected from the group consisting of dodecyl, tetradecyl, hexadecyl, and mixtures thereof.

6. A detergent composition in accordance with claim 5 which additionally contains about 0.5 part by weight to about 10 parts by weight of a detergency builder, for each part by weight of said ternary combination.

7. A detergent composition in accordance with claim 5 which additionally contains about 2 parts by weight to about 5 parts by weight of a detergency builder for each part by weight of said ternary combination.

8. A detergent composition comprising i. about 1% to about 10% of a condensate of a $C_{14}$–$C_{15}$ substantially linear primary alkanol and about 13.5 molar proportions of ethylene oxide, about 25% of the molecules of said alcohol having lower alkyl branching on the 2-carbon, ii. about 0.2% to about 10% of a condensate of a $C_{12}$–$C_{15}$ substantially linear primary alkanol and about 3 molar proportions of ethylene oxide, about 25% of the molecules of said alcohol having lower alkyl branching on the 2-carbon, iii. about 0.2% to about 12% of the N-monoethanolamide of coconut oil fatty acids, the weight ratio of (ii) to (iii) being 1:15 to 15:1, and iv. a detergent builder selected from the group consisting of sodium tripolyphosphate, sodium carbonate, and mixtures thereof, the weight ration of said builder to the sum of (i), (ii), and (iii) being from about 0.5 to about 10.

9. In combination, a ternary composition suitable for incorporation into a detergent composition to enhance the anti-redeposition properties thereof comprising:

i. about 1 to about 20 parts by weight of a water-soluble polyetheneoxy organic nonionic detergent compound of a condensate of ethylene oxide and a primary or secondary alkanol having about 8 to about 16 carbon atoms, the proportion of combined ethylene oxide being from about 52% to about 80% by weight, and mixtures thereof;

ii. about 0.3 to about 10 parts by weight of a substantially water-insoluble polyalkyleneoxy nonionic compound of a condensate of ethylene oxide and a primary or secondary alkanol having about 8 to about 16 carbon atoms, the proportion of combined ethylene oxide being from about 10% to about 51% by weight, and mixtures thereof; and iii. about 0.3 to about 10 parts by weight of an organic compound selected from the group consisting of a. N-alkanol alkaneamides having the formula

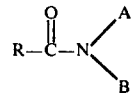

wherein R is an alkyl group having about 8 to about 18 carbon atoms, A is an alkanol group having 1–3 carbon atoms, and B is a member selected from the group of hydrogen and an alkanol group having 1–3 carbon atoms, b. tertiary amine oxides having the formula $R^1R^2R^3N \rightarrow O$ wherein $R^1$ is an alkyl group having about 8 to about 18 carbon atoms, and $R^2$ and $R^3$ are independently methyl, ethyl, or hydroxyethyl groups, and c. alkyl sulfoxides having the formula $R^4R^5S \rightarrow O$ wherein 1. $R^4$ is alkyl having about 10 to about 18 carbon atoms,
2. $R^5$ is an alkyl radical having 1 or 2 carbon atoms, or a hydroxyethyl radical, and mixtures of a, b, and c;

the proportions of (i), (ii), and (iii) being selected to provide improved anti-redeposition characteristics when said composition is employed to wash spun Dacron, said parts by weight being expressed on the basis of the total of (i), (ii), and (iii).

* * * * *

UNITED STATES PATENT OFFICE

CERTIFICATE OF CORRECTION

PATENT NO. : 3,953,382

DATED : April 27, 1976

INVENTOR(S) : Roger E. Nelson et al

It is certified that error appears in the above-identified patent and that said Letters Patent are hereby corrected as shown below:

Claim 1, column 17, line 20: Change "8%" to -- 80% --.

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*